United States Patent [19]

Weiner

[11] 4,210,230

[45] Jul. 1, 1980

[54] FLAT-PACK LUGGAGE CASE

[75] Inventor: Jay H. Weiner, New Castle, Pa.

[73] Assignee: Airway Industries, Inc., Ellwood City, Pa.

[21] Appl. No.: 33,463

[22] Filed: Apr. 26, 1979

[51] Int. Cl.[2] ..... A45C 7/00

[52] U.S. Cl. ..... 190/43; 190/49

[58] Field of Search ..... 190/43, 49, 50, 53, 190/41 C

[56] References Cited

U.S. PATENT DOCUMENTS

| | | | |
|---|---|---|---|
| 2,839,167 | 6/1958 | Smith | 190/43 |
| 3,504,772 | 4/1970 | Barry | 190/49 X |
| 3,977,501 | 8/1976 | Alonso | 190/49 |
| 4,160,496 | 7/1979 | Knight | 190/43 |

FOREIGN PATENT DOCUMENTS

| | | | |
|---|---|---|---|
| 1191799 | 4/1959 | France | 190/43 |

*Primary Examiner*—Donald F. Norton

*Attorney, Agent, or Firm*—Buell, Blenko & Ziesenheim

[57] ABSTRACT

A luggage case or bag of the unstructured type having a semi-rigid support frame with a plurality of strips fixed on the interior of the case, such as at the four corners, forming pockets into which thin flexible sheets or inserts of lightweight material such as plastic material may be optionally disposed or removed. With the inserts removed, the bag may be fully collapsed to a flat position. With the inserts installed, the edgewise rigidity of the inserts supports the body gussets, or walls, of the case in the manner of a fully structured or framed case. In a modified arrangement, the interior pockets are oriented vertically to enable installation of the inserts through the top opening of the pocket. The inserts have some longitudinal rigidity and project in part above the top of the body gusset to provide a structured support to the body and lid gussets and assist in alignment of the lid and body.

7 Claims, 7 Drawing Figures

Figure 4:
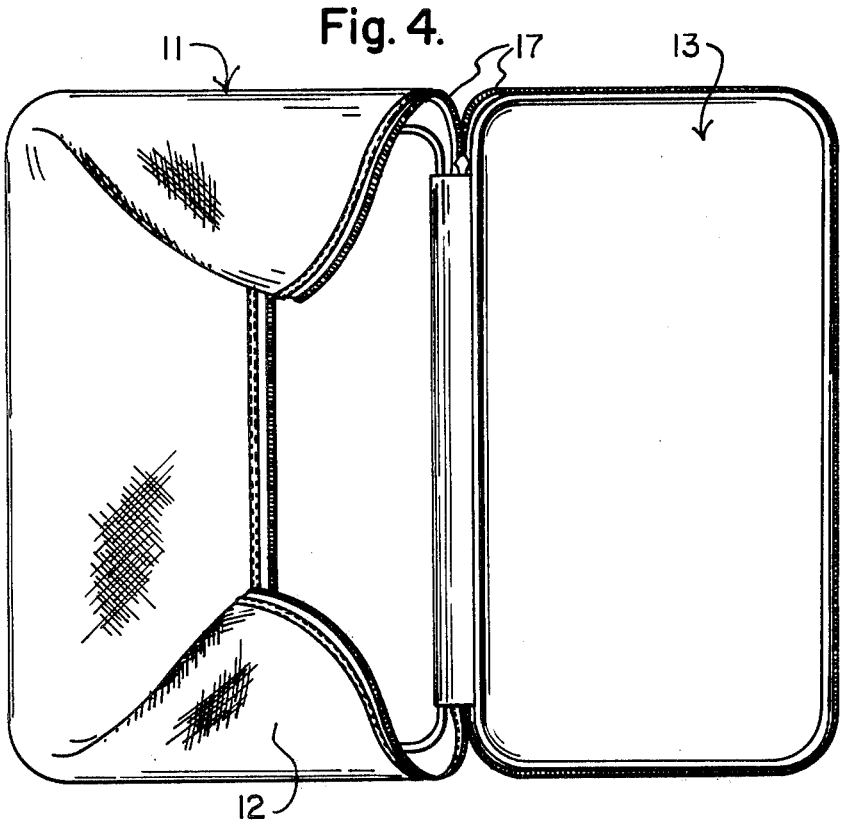

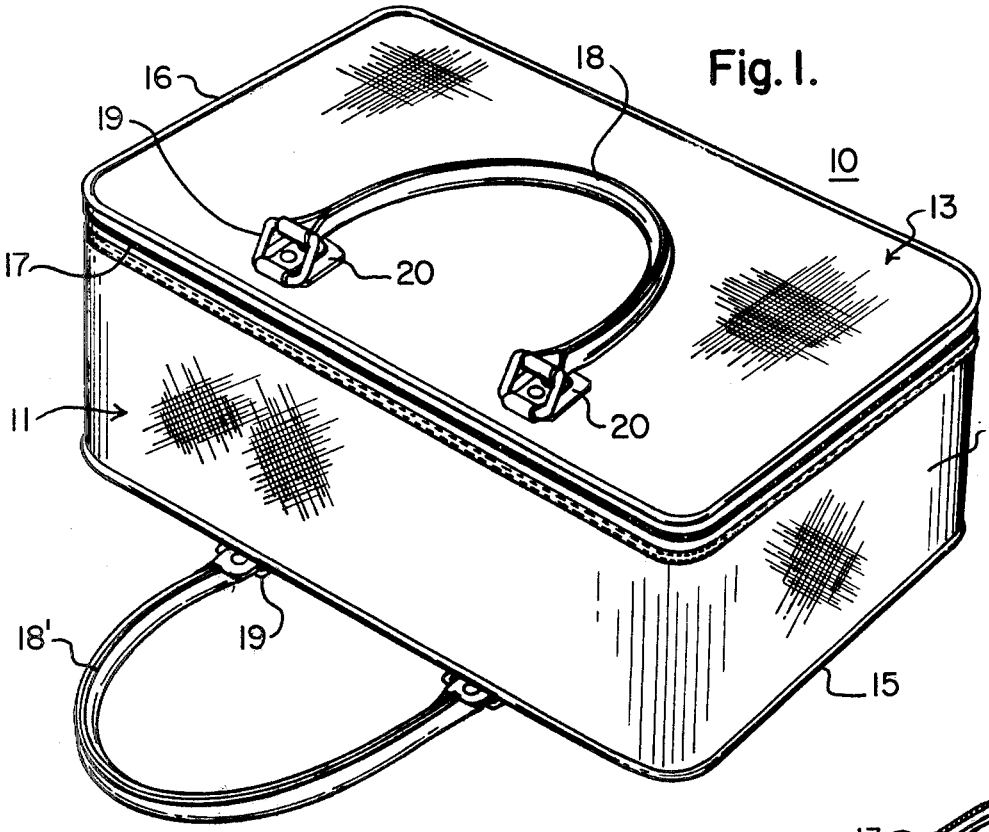
Fig. 1.
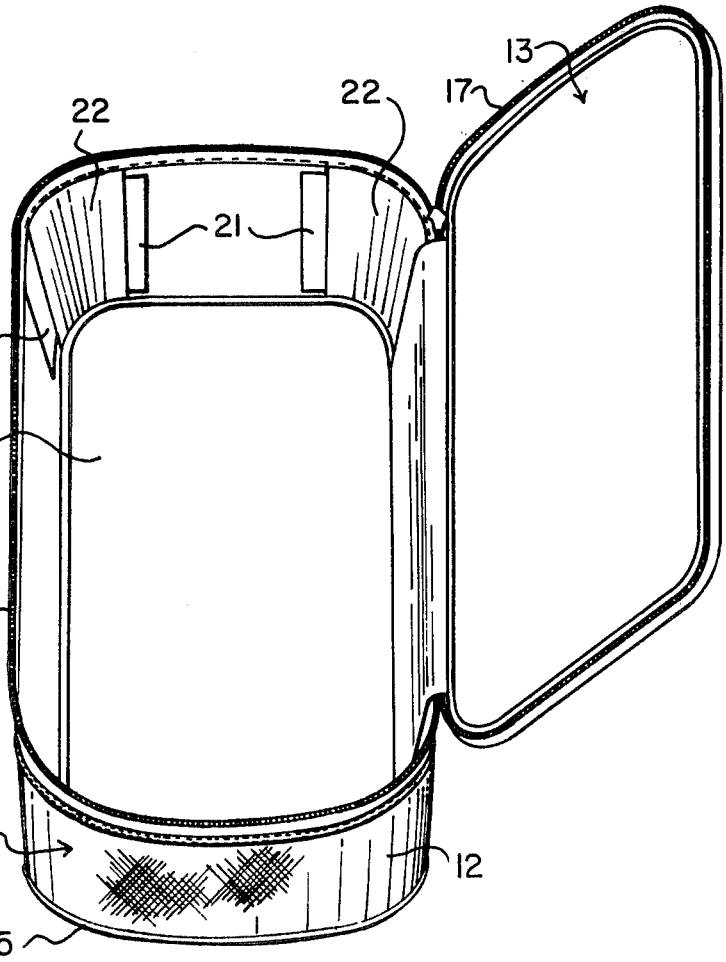
Fig. 2.
Fig. 3.
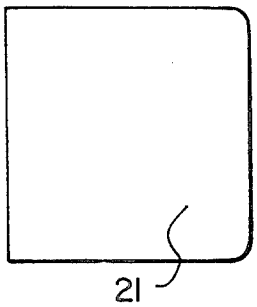

FLAT-PACK LUGGAGE CASE

This invention relates to luggage cases of the soft-sided type, either structured or unstructured. The structured cases have a rigid frame of metal, wood, cardboard or plastic fixed to the body wall or gusset. The wood or cardboard frame is usually as wide as the body gusset. Structured luggage cases must be shipped full size or full shape. The unstructured luggage cases usually are provided with two parallel wire frames affixed at the bottom of the body gusset and at the top of the lid gusset. The unstructured luggage cases are in most cases capable of being shipped in a collapsed or flat condition. However, the customer who uses unstructured luggage has great difficulty in packing the case as the body gusset will not stand up. Moreover, when the unstructured luggage case is empty, or not fully packed, it has an unsightly appearance.

It is an object of my invention to provide an improved luggage case of the unstructured type, capable of being collapsed to a flat condition and packed for shipment in stacks, and hereinafter referred to as a "flat-pack" Luggage Case.

It is a further object to provide a flat-pack luggage case capable of conversion to the appearance of a structured form quickly and readily, to enable the user to pack the luggage case with the same ease as a structured luggage case.

To attain the above objects I construct as a part of the interior lining of the unstructured luggage case, a plurality of horizontal pockets preferably located at the four corners of the case, and open at opposite ends and provide a plurality of relatively thin flat and flexible inserts of lightweight material, for example, plastic material, which when inserted into the pockets provide support for the body gusset. The inserts are of sufficient edgewise rigidity to support the body gussets of the luggage case as fully as if the luggage case were fully structured. The flexible inserts are removed from the pockets and placed in a flat position on the bottom of the case when it is desired to put the luggage case in a collapsed or flat-pack condition.

I further provide a modified structure in which the interior pockets are disposed vertically with an opening at the top into which the flexible inserts may be placed. Notwithstanding the flexibility, the inserts are of sufficient longitudinal rigidity when so placed as to support the body gusset. In addition, they are of such a length as to project in part above the top opening of the vertical pockets so as to provide support for the gusset of the lid of the luggage case when it is moved to a position meeting the top edge of the body gusset.

The advantages of a luggage case constructed according to my invention will be readily apparent. From an appearance standpoint, the unstructured bag or case looks like a fully structured case, has an improved appearance both when packed and when unpacked, and the corner edges are protected against damage. In addition, shipment of the bag may be made in stacked arrangements while collapsed, thus enabling a saving in freight costs over that for fully structured luggage cases. Also, it is possible for a merchant or other user to quickly install inserts in the flat-pack bag on receipt for display or other purposes. Retail merchants currently are required to stuff the unstructured bags with disposable paper material to maintain the shape of the case, for display purposes, which is avoided by my invention.

I am aware that in some soft sided luggage bags of the structured type having a metal frame, it is known to provide a thin flexible sheet permanently fixed between the metal frame and cover or gusset, to enable alignment of the lid with the body of the case and incidentally to provide some support for the lid and hold the part of the slide fastener or "zipper" on the edge of the lid for cooperative mating relation to the part of the slide fastener in the main body portion of the case. Such a luggage case must, however, be stored or shipped "full size" at its full height or depth and cannot be folded or collapsed.

Figure 5:
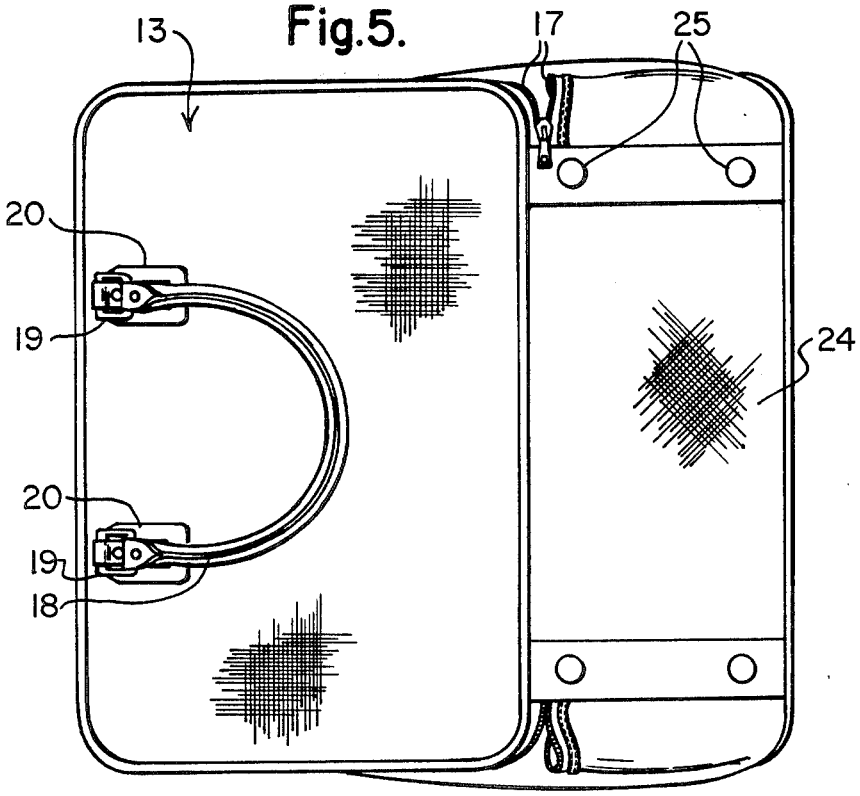
Figure 6:
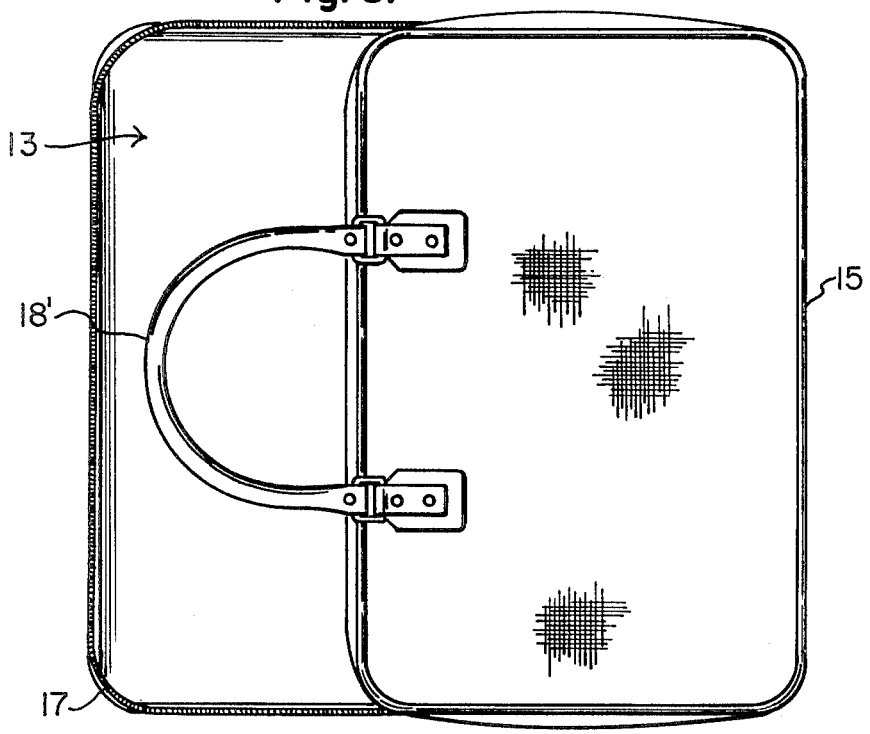
Figure 7:
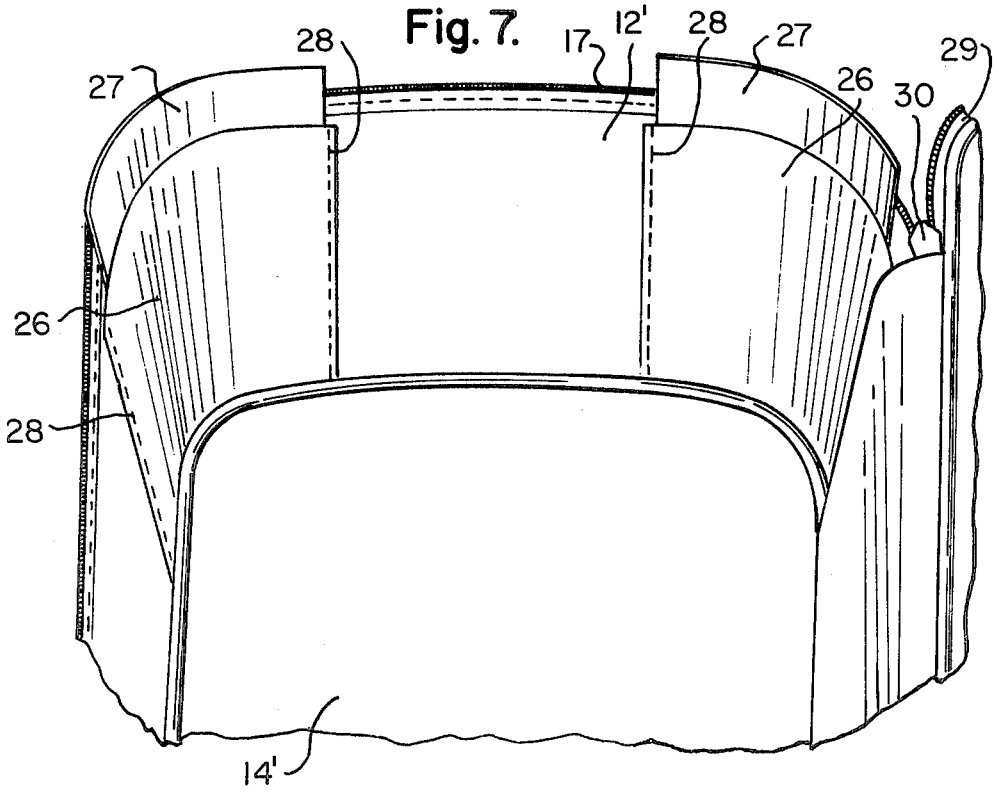

A detailed description of a preferred embodiment of a luggage case made according to my invention is given hereinafter in connection with the accompanying drawings, wherein:

FIG. 1 is a perspective view of a luggage case embodying my invention, shown lying on a side with the lid closed, FIG. 2 is a perspective view of the luggage case of FIG. 1 with the lid raised and exposing the interior to view, FIG. 3 is a plan view of one of the flexible inserts shown in FIG. 2, FIG. 4 is a plan view of the luggage case of FIG. 1, as it appears when partially collapsed toward a flat position, FIG. 5 is a plan view of the luggage case of FIG. 4, as it appears when fully collapsed to a flat position, FIG. 6 is a plan view of the luggage case of FIG. 1 when fully collapsed, as viewed from the side opposite to that of FIG. 5, and FIG. 7 is a fragmentary view, similar to that of FIG. 2 except on somewhat larger scale, showing a modified arrangement of the interior pockets allowing the inserts to be installed in a vertical position.

Referring to the drawings, particularly FIGS. 1 and 2, there is shown a luggage case 10 of the unstructured type in which my invention is illustratively embodied. The case shown comprises a body portion 11 having a side wall or gusset 12 of suitable flexible sheet material. The case further comprises a lid 13 hinged to the body portion and a bottom 14 of flexible sheet, both of material similar to that in the side wall 12. A semi-rigid wire contained within a welting 15 at the bottom of the side wall extends peripherally around the bottom 14. A semi-rigid wire is also contained within a welting 16 peripherally surrounding the lid 13.

A slide fastener 17 of the "zipper" type is shown for fastening or locking the lid 13 to the body, one part of the tape of the zipper fastener being stitched to the top edge of the body portion 11 and the other tape part of the zipper fastener being stitched to the peripheral edge of the lid.

A pair of cooperating loop handles 18 and 18' are attached respectively to the lid 13 and the bottom 14, through metallic swivels 19, which are in turn anchored in pads 20 of leather or vinyl material riveted to the lid and the bottom.

In order to provide a structured look to the side walls 12, there are provided, according to my invention, a plurality of rectangular sheets 21 of plastic material (FIG. 3) for insertion horizontally into flat sleeves or pockets at each of the four corners of the interior of the case. The sleeves or pockets are formed between the interior surface of the side wall 12 and strips 22 of textile material attached along the top and bottom edges thereof by the same stitching as that by which the tape of zipper 17 and the tape of the welting 15 are attached to the side wall 12. The ends of the strips 22 are preferably doubled over and hemmed to provide a durable edge but are not stitched to the wall of the case.

The sheets 21 of plastic material are flexible longitudinally so that when they are inserted horizontally into the corner pockets formed by the strips 22 of textile material, they bend in conformity with the curvature of the side wall 12. The sheets 21 are moreover of such thickness as to provide an edgewise rigidity sufficient to support the wall 12 in a manner to provide a structured appearance, as shown in FIGS. 1 and 2.

When it is desired to collapse the case 10, the plastic sheets 21 are removed from the pockets and laid flat inside the case on the bottom 14. The case may then be completely collapsed by pushing the side walls 12 inwardly to the position shown in FIG. 4 and then lapping the lid 13 over the bottom 14 to the position shown in FIG. 5. In this position, a portion 24 of the side wall 12 appears which has support lugs 25 of rubber or vinyl material attached thereto. It will be apparent that the portion 24 of the side wall acts as the bottom of the case on which the case may stand in its structured form.

The case 10 in its completely collapsed form as shown in FIG. 5, may be reversed in position, and as so reversed is shown in FIG. 6.

It will be apparent that the storage space required for a given number of cases 10, particularly when stacked, is much less when in the collapsed form, shown in FIGS. 5 and 6, as compared to the structured form shown in FIG. 1. Cost of shipment is thus correspondingly reduced by stacking the cases in collapsed form. At the same time, the luggage case 10 may be readily and quickly restored to its structured form simply by inserting the plastic sheets 22 in the interior wall pockets of the case.

An alternate embodiment of my invention is shown in FIG. 7.

In this embodiment, interior corner pockets are provided in the case by attaching strips 26 of textile material to the wall 12' of the luggage case so as to provide pockets into which sheets 27 of plastic material may be inserted vertically. In this case, the strips 26 are attached directly to the wall 12', as by stitching at 28 along the two opposite side edges of the strips. The upper edge of the strips 26 is left unstitched to provide an opening or entrance for the plastic sheets 27 to be inserted vertically downward.

Like sheets 21, the plastic sheets 27 are sufficiently flexible to follow the curvature of the wall 12' at the corners of the case but are of such rigidity lengthwise as to provide a vertical support for the wall 12'.

In length, the plastic sheets 27 are higher than the height of the wall 12' and project above the zipper fastener 17' along the top edge of the wall 12'. This serves a dual purpose, namely to support the narrow side wall or gusset 29 (FIG. 7) of the lid 13 and to insure proper alignment of the lid with the wall of the body to enable the slider element 30 of the zipper fastener to engage both parts of the fastener.

As in the case of the previously described embodiment, the luggage case in FIG. 7 may be similarly collapsed, simply by removing the plastic sheets 27 from the interior corner pockets of the case and depositing them on the interior surface of the bottom 14' of the case before collapsing.

While I have illustratively shown several embodiments of my invention, it will be apparent that variations therein are possible and no limitations are intended except such as are defined in the following claims.

I claim:

1. A flat-pack luggage case having a body and a lid hinged thereto wherein the body and lid have flexible walls and are collapsible to a flat position, the improvement comprising a plurality of short relatively thin flexible sheets having an edgewise rigidity optionally installable separately in certain fixed positions respectively in the case to support the flexible walls of said body and impart a structured appearance thereto, and removable therefrom to flat non-fixed positions in the case for imparting alternatively thereto a flat-pack appearance.

2. A luggage case of the unstructured type having a body of substantially rectangular shape and a lid hinged thereto wherein the walls of the body and of the lid are flexible and unsupported and the body and lid may be collapsed to a flat position, wherein the improvement comprises means providing a plurality of pockets on the interior of the body of the case and closely paralleling the walls thereof, at the four corners thereof, and a plurality of short relatively thin flexible sheets installed respectively in said pockets to form rounded corners for the case and having an edgewise rigidity sufficient to support the flexible walls of the body and to impart a structured appearance thereto.

3. A luggage case of the unstructured type having a body and a lid hinged thereto wherein the walls of the body and of the lid are flexible and unsupported and the body and lid may be collapsed to a flat position, wherein the improvement comprises a plurality of pockets formed by strips of textile material fixed at top and bottom on the interior of the body of the case at the corners therof in close parallel relation to the walls of the body with openings at opposite ends and a plurality of short relatively thin flat flexible sheets installed respectively in said pockets through said openings and having an edgewise rigidity sufficient to support the flexible walls of the body of the luggage case to impart a structured appearance thereto while being bent so as provide rounded corners to the case.

4. A luggage case according to claim 3, wherein a slide fastener is provided partly on the upper edge of the wall of the body and partly on the lower edge of the wall of the lid for locking said lid to said body, said slide fastener being secured to the body and lid by stitching, and wherein said pockets are formed by strips of textile material secured in position by the same stitching as that for attaching the slide fastener to the body wall.

5. A luggage case of the unstructured type having a body and a lid hinged thereto wherein the walls of the body and of the lid are flexible and unsupported and the body and lid may be collapsed to a flat position, the body wall having a protective welting attached thereto along the bottom of the case and one part of a slide fastener attached along the top edge, wherein the improvement comprises a plurality of pockets formed by strips of textile material fixed on the interior of the body of the case at the corners of the case in close parallel relation to the walls of the body with openings at opposite ends and a plurality of short relatively thin flat flexible sheets installed respectively in said pockets through said openings and having an edgewise rigidity sufficient to support the flexible walls of the body of the luggage case and to impart a structured appearance thereto, said pockets being formed by strips of textile material secured in position at top and bottom by the same means as that by which the slide fastener and the welting are attached.

6. A luggage case of the unstructured type having a body and a lid hinged thereto, wherein the walls of the body and lid are flexible and unsupported except at the bottom and top edges respectively and are collapsible to a flat position, and wherein the improvement comprises a plurality of strips of textile material fixed in a vertical position closely paralleling the wall of said body to form pockets having one end opening at the top of the body wall, and a plurality of relatively thin flexible sheets installed respectively into said end openings, said sheets being sufficiently flexible laterally to follow the contour of the wall of said body and having a longitudinal rigidity sufficient to support the wall of the body.

7. A luggage case according to claim 6 wherein the said thin flexible sheets have a length such as to project above the top edge of the wall of said body, to provide a means for alignment of the said lid with the body and to support the wall of the lid when the lid is moved into closing relation to the wall of the body.

* * * * *